US012104879B2

(12) United States Patent
Kanarek et al.

(10) Patent No.: US 12,104,879 B2
(45) Date of Patent: Oct. 1, 2024

(54) MODIFIED APPAREL FOR GUN SUPPORT

(71) Applicants: Michel Kanarek, Parkland, FL (US); Michael Smith, Friendswood, TX (US)

(72) Inventors: Michel Kanarek, Parkland, FL (US); Michael Smith, Friendswood, TX (US)

( * ) Notice: Subject to any disclaimer, the term of this patent is extended or adjusted under 35 U.S.C. 154(b) by 92 days.

(21) Appl. No.: 17/973,901

(22) Filed: Oct. 26, 2022

(65) Prior Publication Data

US 2024/0142198 A1 May 2, 2024

(51) Int. Cl.
*F41C 33/04* (2006.01)
*A41D 1/06* (2006.01)
*A41D 27/20* (2006.01)

(52) U.S. Cl.
CPC ..... *F41C 33/046* (2013.01); *A41D 1/06* (2013.01); *A41D 27/20* (2013.01); *F41C 33/048* (2013.01)

(58) Field of Classification Search
CPC ..... F41C 33/046; F41C 33/048; A41D 1/06; A41D 27/20
See application file for complete search history.

(56) References Cited

U.S. PATENT DOCUMENTS 6,148,443 A * 11/2000 Maastricht ..... A63B 57/00 2/69
6,182,297 B1 * 2/2001 Duren ..... A41D 13/0575 450/99
6,772,446 B1 * 8/2004 Black ..... A41B 9/04 2/400
7,058,987 B2 * 6/2006 Salazar ..... A41D 1/06 2/247
8,839,464 B2 * 9/2014 French ..... F41C 33/048 2/248
9,581,414 B1 * 2/2017 Mironski ..... F41C 33/046
10,517,341 B2 * 12/2019 Swan ..... F41C 33/048
2003/0205595 A1 * 11/2003 Young ..... F41C 33/0218 224/230
2004/0026471 A1 * 2/2004 Gallagher ..... F41C 33/0209 224/269
2005/0066424 A1 * 3/2005 Salazar ..... A41D 13/0012 2/227
2007/0250980 A1 * 11/2007 Pellerin ..... F41C 33/0209 224/587
2012/0085802 A1 * 4/2012 Ferrante ..... F41C 33/046 224/625
2013/0091619 A1 * 4/2013 Hacker ..... A41D 1/08 2/228
2014/0259300 A1 * 9/2014 Iosilevich ..... A45F 3/14 2/300

(Continued)

*Primary Examiner* — Khaled Annis
(74) *Attorney, Agent, or Firm* — MARK A. LITMAN & ASSOCIATES, P. A

(57) ABSTRACT

A fabric garment to be worn by a human having a waistband in the garment, the fabric garment having a holster internal to the fabric of the fabric garment adjacent at least one hip side of the fabric garment:

a) the fabric garment having a body centered forward position;
b) the waistband in the garment having asymmetrical distances from the body centered forward position to a left hip position and a right hip position on the waistband;
c) a longer distance of the asymmetrical distances on a hip having the holster internal to the fabric of the fabric garment;

the holster having an opening therein into which an object can be received and supported.

8 Claims, 4 Drawing Sheets

(56) References Cited

U.S. PATENT DOCUMENTS

| | | | | |
|---|---|---|---|---|
| 2015/0089708 | A1* | 4/2015 | Trevino | A41D 13/0012 2/69 |
| 2015/0359273 | A1* | 12/2015 | Olson | A41D 13/0012 2/250 |
| 2016/0095372 | A1* | 4/2016 | Peterson | A41D 27/204 2/248 |
| 2016/0100642 | A1* | 4/2016 | Swan | A45F 5/021 224/191 |
| 2016/0209164 | A1* | 7/2016 | Fravala | F41C 33/048 |
| 2019/0137216 | A1* | 5/2019 | Gordon | F41C 33/0218 |
| 2020/0068968 | A1* | 3/2020 | Robinson | A41D 1/08 |
| 2022/0160066 | A1* | 5/2022 | Spanopoulos | F41C 33/048 |
| 2023/0189909 | A1* | 6/2023 | Moss | F41C 33/041 2/250 |

* cited by examiner

MODIFIED APPAREL FOR GUN SUPPORT

BACKGROUND OF THE INVENTION

1. Field of the Invention

The present invention relates to the field of functional apparel, particularly pants, and particularly pants or skirts with an embedded holster.

2. Background of the Art

For concealed-carry of a gun, many individuals with concealed-carry licenses choose not to place their handgun within the loop of their pants or skirt due to the presence of the gun causing the waistband to be dislocated, with more material forced to one side of the pants than the other. This results in the center and seam of the pants becoming off-center and causing discomfort to the wearer.

Alternative traditional means of securing a handgun include belt and shoulder, back and ankle holsters. Belt holsters may be worn high and close to the body, slightly behind the hip bone, and may be concealed under a long, untucked shirt or jacket. In order to maximize concealment, many clothing systems require the bearer to conceal their weapon underneath standard clothing or on the inside of the article of clothing, such as placement of a holster inside the waist of pants. This results in the pants becoming lopsided and again causing discomfort for the wearer of the pants or skirt.

Accordingly, there is a need for pants or skirts that allow for the concealment of a holster without resulting in the lopsidedness of the pants and discomfort for the wearer.

U.S. Pat. No. 11,259,583 [name] discloses an article of clothing comprising a waistband configured to secure and carry at least one object on a wearer's waist. The waistband includes a first portion configured to form a circumferential waist part of the article of clothing and include at least a first channel and a second channel, the first channel having an elastic band therethrough, and the second channel having drawstrings therethrough. The waistband also includes a second portion configured to include a plurality of belt loops evenly spaced and positioned along the first portion of the waistband, wherein the plurality of belt loops are configured to receive a belt assembly therethrough.

U.S. Pat. No. 9,557,139 (Miner) discloses an article of apparel including a concealed weapon pocket positioned at a location on the article of apparel which allow for easy access by a user, such as a lower side portion of a coat or jacket, for example. The front panel includes an upper portion that is releasably secured about its top edge and upper side edges to the main panel, and a lower portion that is fixably secured about its bottom and lower side edges to the main panel. A flap associated with a front cargo pocket may be grasped by hand and moved in a generally forward and downward direction to expose the upper portion of the concealed weapon pocket. The user may then grasp and deploy a weapon disposed in the pocket with minimized structural interference from any portion of the pocket or surrounding apparel structure.

U.S. Pat. No. 8,839,464 (French) discloses a garment pocket configured to carry, in a concealed and readily-accessible state, a handgun or other object. The garment pocket has a receiving zone where the handgun or other object can be carried. The relative position of the receiving zone can be adjusted for the comfort of the wearer or to increase the concealment of the handgun or object in the receiving zone. In addition, a guard can be positioned on the outer surface of the pocket to prevent objects outside of the pocket from protruding into the receiving zone.

SUMMARY OF THE INVENTION

A fabric garment to be worn by a human having a waist structure in the garment, the fabric garment having a holster in linear orientation to the fabric or covered by the fabric of the fabric garment adjacent at least one hip side of the fabric garment:

a) the fabric garment having a body centered forward position;
b) the waist structure in the garment having asymmetrical distances from the body centered forward position to a left hip position and a right hip position on the waist structure;
c) a longer distance of the asymmetrical distances on a hip having the holster internal to the fabric of the fabric garment;
d) the holster having an opening therein into which an object can be received and supported.

DETAILED DESCRIPTION OF THE INVENTION

A fabric garment to be worn by a human having a waist structure in the garment, the fabric garment having a holster in linear orientation with or beneath the fabric of the fabric garment adjacent at least one hip side of the fabric garment:

e) the fabric garment having a body centered forward position;
f) the waist structure in the garment having asymmetrical distances from the body centered forward position to a left hip position and a right hip position on the waist structure;
g) a longer distance of the asymmetrical distances on a hip having the holster internal to the fabric of the fabric garment;
h) the holster having an opening therein into which an object can be received and supported.

By use of the term linear orientation it is mean that the top of the holster is approximately linearly flush or aligned with the waist fabric material, with no continuous fabric covering or fabric overlain on the holster material.

Figure 1:
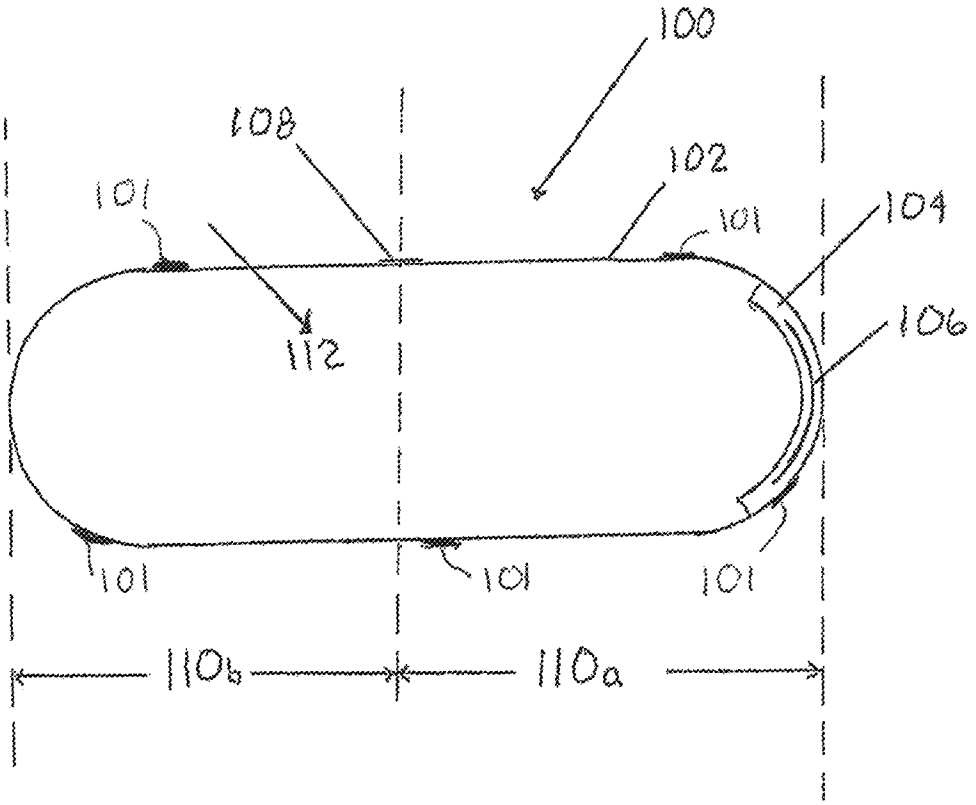
FIG. 1 is a top vertical view of the waistband of a pair of asymmetric pants or a skirt containing a holster on the interior of the pants.

FIG. 1 shows the top view of a pair of asymmetric holster pants 100. An exterior of the pants is constructed from any clothing fabric 102 such as natural fibers or synthetic fibers, including but not limited to denim, flannel, cotton, linen, wool, or blends thereof for any other fabric suitable for the construction of traditional pants, shorts, skirts, jeans, sweat-pants, ski pants, or other such hip supported or hip hugging lower body clothing garment. Dresses, work clothes or overalls with an exposed hip area or a on exposed hip area built into the garment are also useful in the practice of the present invention.

A holster is constructed from a compressible material, preferably a compressible elastomeric composition (e.g., with an elastic memory so that when compressed, the material can repeatedly return to its original dimensions) 104 such as natural or synthetic elastomers including but not limited to solid and foam and reticulated elastomeric materials, such as rubber, artificial rubber, synthetic elastomers (e.g., Neoprene® rubber, silicones elastomers, polyurethane elastomers, acrylonitrile, butadiene and styrene elastomers) and contains a holster slot 106 capable of concealing an object within it, particularly a hand gun. The holster is preferably located inside the interior of the garment, such as the pants or skirt (the material may also extend equal to or beyond the structural material of the garment), preferably on a hip side of the waistline of the pants. In other embodiments the center of the holster or the center of the holster slot may be located in different positions within the interior of the pants, slightly forward to, slightly rearward of or centrally positioned with respect to the most outward extension of the wearer's hip.

In one embodiment, asymmetric holster pants 100 contain a zipper 108 that is off-center from (asymmetric to) the middle of the front of the pants. Other embodiments may not contain a zipper 108 (buttons or Velcro® fasteners or draw strings or elastic), however, the design or feature that traditionally marks the middle of the front of a pair of pants may be or should be similarly off-center in asymmetric holster pants. In embodiments that contain a seam, the seam should be offset similarly to the offset of the zipper 108. The pants are constructed such that the waistline of the pants have a longer side distance 110*a* and a shorter side distance, where the longer side distance 110*a* is the distance from the zipper to the outermost point on the hip of the waistline of the pants on the side of the pants containing the holster, and where the shorter side distance 110*b* is the distance from the zipper to the outermost point on the hip of the waistline of the pants on the side of the pants not containing the holster. The waistline of the side of the pants having a shorter side distance 110*b* would be similar to that of the construction of traditional pants, skirts, culottes, shorts, jeans, sweatpants, ski pants, or any other lower torso covering clothing garment as described herein. The waistline of the side of the pants having a longer side distance 110*a* would be unlike the construction of traditional pants in that it is longer than the waistline of traditional pants. The extra length of the waistline is to allow room for the holster and an object within the holster to exist within the interior of the pants while the pants are being worn. There may be at least one belt loop 101 in the pants (FIG. 1).

The pants have a volume 112 that is large enough for the wearer to insert legs, hips, and anything else that would be covered by traditional pants into the interior of the pants or skirt in addition to the holster and object concealed in the holster inside the pants.

Figure 2:
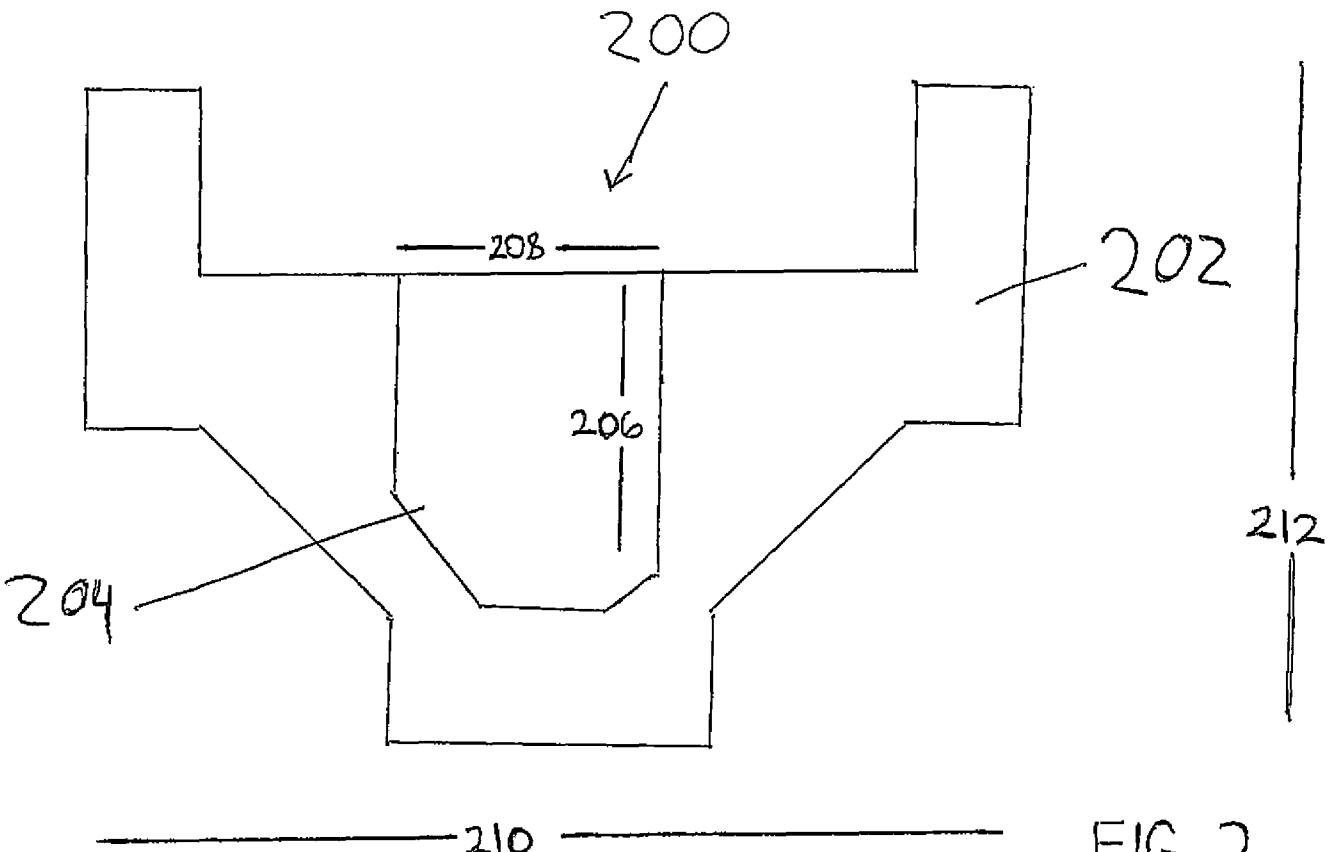
FIG. 2 is a side view of a preferred embodiment of a holster that is attached to the interior of the waistband of the pants or skirt.

FIG. 2 shows a preferred embodiment of holster 200 attached within the asymmetric holster pants or skirt 100. Holster 200 will be made from a preferably elastomeric compound and attached on the interior of the holster pants 100, preferably at the hip. The outer casing 202 will attach to the asymmetric holster pants on one side, and the outer casing 202 will preferably encompass the inner casing 204 on all sides except on the top for insertion of the gun into inner casing 204. Inner casing 204 has a width 208 and depth of 206 to allow a sidearm or other concealed object to be sufficiently secure upon insertion. Furthermore, outer casing 202 has width 210 and depth 212 to fit within the asymmetric holster pants 100 while further securing a sidearm or other concealed object.

Figure 3:
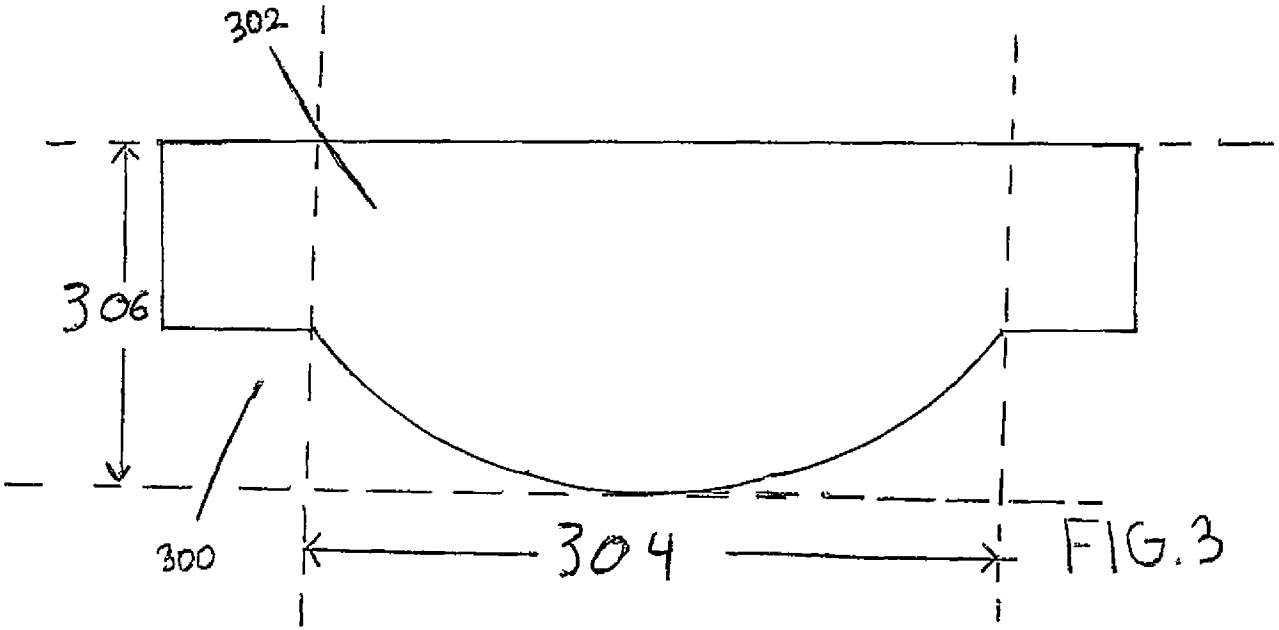
FIG. 3 is a side view of an alternative embodiment of a waistband holster attached to the interior of the waistband of pants or skirt.

FIG. 3 shows an alternative embodiment of a holster 300 made of an elastomeric compound. The outer casing of the holster 300 is attached to the asymmetric holster garment 100. In this embodiment, the holster 300 has a semi-circle shape; however, alternative embodiments using other shapes for the holster are possible. The holster 300 has a width 304 and depth 306 such that the volume of the holster 300 is large enough to contain a hand firearm or other concealed object.

Figure 4:
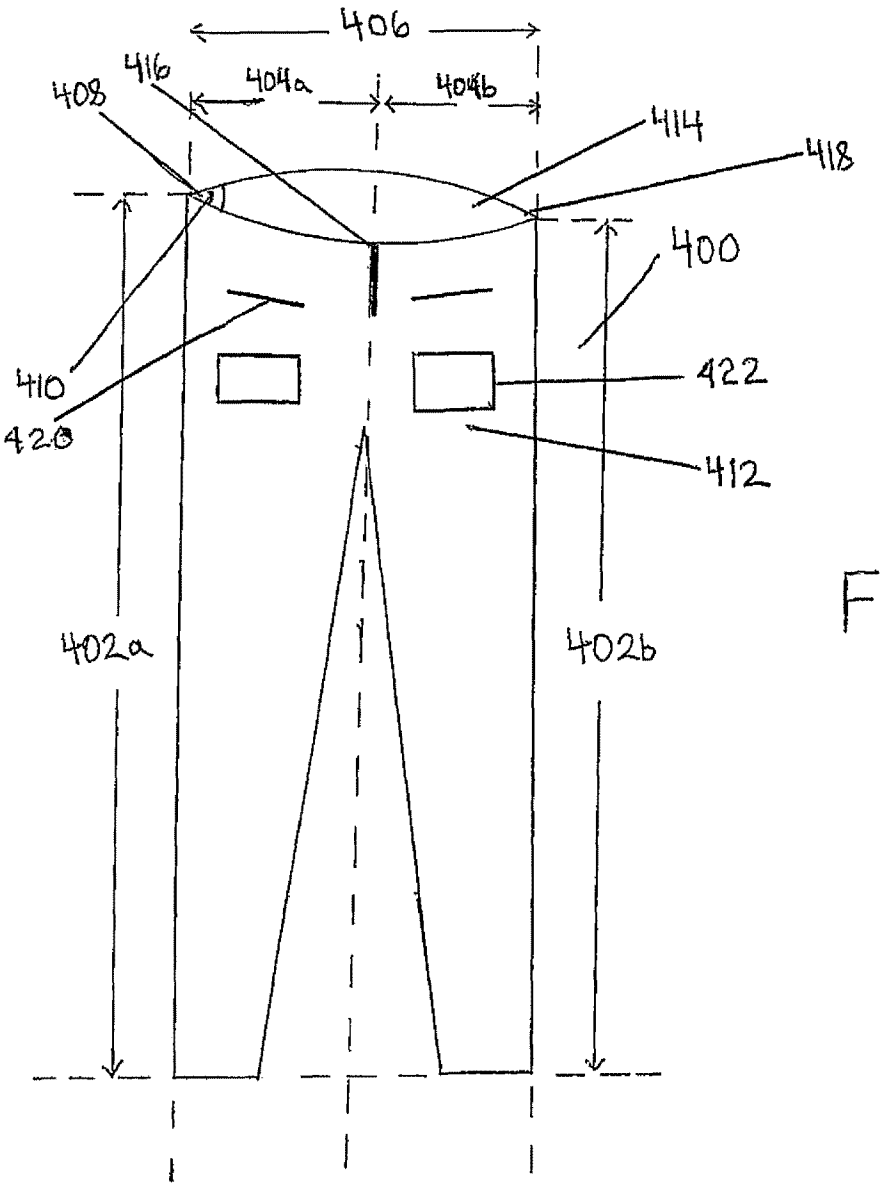
FIG. 4 shows the front view of an alternative embodiment of the current generic invention, wherein there is also an asymmetric waist height in the holster pants.

FIG. 4 shows the front view of an alternative embodiment of the current generic invention, asymmetric holster pants 400. In this embodiment, the hip-to-hip distance of the pants 406 is laterally asymmetric and the pants are constructed such that the gun-side waistline 418 of the pants have a normal, relaxed state, higher side distance 404*a* and a lower side (out-seam, top of waits to bottom of cuff) distance, where the longer side distance 404*a* is the distance from the seam, zipper, or other connector 416 to the outermost point on the hip of the waistline of the pants on the side of the pants containing a holster 408, and where the shorter side distance 404*b* is the distance from the seam, zipper or other connector 416 to the outermost point on the hip of the waistline of the pants on the side of the pants not containing the holster. When a firearm or other object 410 is inserted into the holster 408, the weight of the object 410 may likely cause the side of the pants 400 containing the object to sag. To remedy this apparel asymmetry, the preferred embodiment of asymmetric holster pants 400, the side of the pants containing the holster 408 is offset vertically from the side of the pants that do not contain the holster such that the when the holster-side of the pants are lowered, and put into a weighted, non-relaxed state, the hip heights and the cuff lengths will be approximately the same (more similar than when the pants are worn in their relaxed state, with the holster side waist height and the cuff length (or skirt length) height being higher than those of the non-holster side of the garment. In the relaxed state, the side of the waist and the cuff/skirt bottom with the holster 408 is vertically higher than the waist or cuff/skirt-bottom side without the holster. As a result of this, the distance from the hip of the holster side of the pants to the ground 402*a* is greater than the distance from the hip of the non-holster side of the pants to the ground 402*b*. The vertically higher side 402*a* should be offset such that when a firearm or object 410 is set into the holster 408, the holster side of the pants/skirt 400 will sag such that it is in alignment with the non-holster side of the pants to give the appearance that the pants are not sagging. Alternatively, or in combination with or without this feature, a belt, suspenders, or other traditional methods for keeping pants from sagging may be used. The height difference may be between 1 cm and 10 cm.

Additional features on the apparel of the present invention may include standard pants features such s pockets 422, belt loops (not shown), cuffs (not shown, coin pockets and the like. Belt loops will preferably be located under the gun holster so as to not restrict access to or hamper removal of the gun from the holster. Non-standard additional elements may include gun clip or bullet pockets 422 for storage of unused or used clips or bullets. These pockets may also be on the sides of the pants and may be used as inserts for knives and knifes in sheaths.

The asymmetric holster pants 400 has an outer fabric 412 that makes at least a majority of the outside materials of the asymmetric holster pants 400. The outer fabric 412 made be made of natural or synthetic fabric materials such as denim, rayon, cotton, polyester, wool, acrylic, linen, silk, hair fibers, derivatives or subspecies of such materials, or combinations of any such items. The inner fabric 414 of the asymmetric holster pants 400 can be made of similar materials denim, rayon, cotton, polyester, wool, acrylic, linen, silk, hair fibers, derivatives or subspecies of such materials, or combinations of any such items. Both the outer fabric 412 and the inner fabric 414 may include various stitching, glue, or other cohesive or binding materials as well as extra materials like leather, cork, leaf fibers, rubber, pleather, Vinylon™ fabric, or similar such items either for designs or as further makeup of the inner fabric 414 and or the outer fabric 412.

A connector for the garment 416 in a front, center of the asymmetric pants waistline 418 will be used. The connector 416 can either be stitching or other cohesive or binding materials to make the connector 416 permanently closed, or the connector 416 could be a zipper, a button, Velcro, or such connectors made of metal, ceramic, or plastic. Also, the waistline 418 may also be a flexible elastic composition that is uneven in its waistline, as outlined in 404*a* and 404*b*, such that holster 408 is better positioned. The waistline may also be off uneven height, as outlined in 402*a* and 402*b*. On waistline 418 or near on outer fabric 412 may contain real or fake pockets 420, designs, belt loops, or logos or trademark designs.

What is claimed:

1. A fabric garment to be worn by a human having a waistband in the garment, the fabric garment having a holster in the fabric of the fabric garment adjacent at least one hip side of the fabric garment:

a) the fabric garment having a body centered forward position and a zipper;

b) the waistband in the garment having asymmetrical distances from the body centered forward position to a left hip position and a right hip position on the waistband;

c) a longer distance of the asymmetrical distances on a hip having the holster internal to the fabric of the fabric garment;

d) the holster having an opening therein into which an object can be received and supported and wherein the longer distance is a distance from the zipper to the outermost point on the hip of the waistline of the fabric garment on the side of the pants containing the holster, and where a shorter distance is the asymmetrical distance from the zipper to the outermost point on the hip of the waistline of the fabric garment on the side of the fabric garment not containing the holster.

2. The fabric garment of claim 1 wherein the fabric garment is selected from the group of pants, dresses or skirts.

3. The fabric garment of claim 1, when the fabric is in a relaxed state, the left or right hip position having the holster internal to the fabric of the fabric garment is relatively higher than the respective right or left hip position.

4. The fabric garment of claim 3 wherein, pockets sized to hold gun clips or multiple bullets are present on the surface of the fabric garment.

5. The fabric garment of claim 1 wherein belt loops are present on the garment such that an inserted belt will pass beneath a gun inserted into a holster.

6. The fabric garment of claim 1 wherein, pockets sized to hold gun clips or multiple bullets are present on the surface of the fabric garment.

7. The fabric garment of claim 1 wherein an interior face of the holster has at least one belt loop therein.

8. The fabric garment of claim 1 wherein the holster is composed of an elastomeric material.

* * * * *